US010239658B1

(12) United States Patent
Crabbs

(10) Patent No.: US 10,239,658 B1
(45) Date of Patent: Mar. 26, 2019

(54) PALLET SPACER

(71) Applicant: Devin A. Crabbs, Egg Harbor Township, NJ (US)

(72) Inventor: Devin A. Crabbs, Egg Harbor Township, NJ (US)

(73) Assignee: ADVANCEPIERRE FOODS, INC., Blue Ash, OH (US)

( * ) Notice: Subject to any disclaimer, the term of this patent is extended or adjusted under 35 U.S.C. 154(b) by 0 days.

(21) Appl. No.: 15/798,986

(22) Filed: Oct. 31, 2017

(51) Int. Cl.
*B65D 19/44* (2006.01)
*B65D 19/00* (2006.01)

(52) U.S. Cl.
CPC ..... *B65D 19/44* (2013.01); *B65D 19/0038* (2013.01); *B65D 2519/00268* (2013.01); *B65D 2519/00815* (2013.01); *B65D 2519/00965* (2013.01)

(58) Field of Classification Search
CPC ..... B65D 19/0071; B65D 19/38; B65D 19/0018; B65D 19/0028; B65D 19/44; B65D 2519/00034; B65D 2519/00069; B65D 2519/00104; B65D 2519/00273; B65D 2519/00293; B65D 2519/00323; B65D 2519/00373; B65D 2519/0094; B65D 2519/00268; B65D 2519/00815; B65D 2519/00965
USPC ..... 108/901, 51.11, 52.1, 53.1, 53.3, 55.3, 108/57.29; 206/386, 595, 596, 598; 248/346.02, 346.4
See application file for complete search history.

(56) References Cited

U.S. PATENT DOCUMENTS 2,544,743 A * 3/1951 Vrabcak ..... B65D 19/0038 108/51.3
2,870,981 A * 1/1959 Dellinger ..... B65D 19/004 108/52.1
3,135,228 A * 6/1964 Fleming ..... B65D 19/0012 108/55.1
3,221,973 A 12/1965 Kalbrener
3,747,780 A * 7/1973 Schneider ..... B65D 19/44 108/53.1
3,776,146 A * 12/1973 Morrison ..... B65D 19/0036 108/52.1
3,946,883 A * 3/1976 Beal ..... B65D 71/0096 108/51.3

(Continued)

FOREIGN PATENT DOCUMENTS

CA 2836163 * 6/2011
EP 2980512 3/2016
ES 2063646 * 1/1995

OTHER PUBLICATIONS

Product Information featuring "40×48 FRS Plastic Nestable Pallet" by Orbis (Aug. 9, 2017).

*Primary Examiner* — Janet M Wilkens
(74) *Attorney, Agent, or Firm* — Thompson Hine LLP

(57) ABSTRACT

A pallet spacer system including a pallet spacer having a pallet spacer body with a plurality of upper portions. Each upper portion has a generally flat upper surface that is aligned with the upper surfaces of the other upper portions. The pallet spacer body further includes a plurality of lower portions, each lower portion having a generally flat lower surface that is aligned with the lower surfaces of the other lower portions. The pallet spacer system includes a plurality of spacers positioned on the upper portions and configured to receive at least an item therebetween.

20 Claims, 4 Drawing Sheets

(56) References Cited

U.S. PATENT DOCUMENTS

| | | | | | |
|---|---|---|---|---|---|
| 4,145,974 | A * | 3/1979 | Fleming | B65D 19/004 | 108/53.3 |
| 4,145,975 | A * | 3/1979 | Colbert | B65D 19/0044 | 108/52.1 |
| 4,435,463 | A * | 3/1984 | Roellchen | B26D 3/006 | 108/901 |
| 4,819,816 | A * | 4/1989 | Noble, Sr. | B65D 19/0016 | 211/189 |
| 5,088,418 | A * | 2/1992 | Reckermann | B65D 19/44 | 108/53.1 |
| 5,566,624 | A * | 10/1996 | Brown | B65D 19/0018 | 108/57.28 |
| 5,598,787 | A | 2/1997 | Pronk | | |
| D447,310 | S * | 8/2001 | Pope | D34/38 | |
| 6,541,097 | B2 * | 4/2003 | Lynch | B27N 5/00 | 108/51.11 |
| 6,974,295 | B2 * | 12/2005 | Coblentz | B63B 25/22 | 108/52.1 |
| 2001/0054369 | A1 * | 12/2001 | Braley | B65D 19/0085 | 108/51.3 |
| 2006/0272556 | A1 * | 12/2006 | Apps | B65D 19/004 | 108/53.1 |
| 2016/0251112 | A1 * | 9/2016 | Embleton | B65D 19/0012 | 700/95 |

* cited by examiner

10'
10
40
28
26
34
18
24
32
30
16
22
14a
38
36
12
20
14b

PALLET SPACER

The current disclosure is directed to a pallet spacer, and more particularly, to a pallet spacer configured to provide spacing between stored items.

BACKGROUND

Pallet spacers are often used to aid in stacking items that are stored on a pallet or the like. Such items are often stored in temperature-controlled environments, such as a cooler or freezer. In some existing pallet spacer systems, the stored items may not be properly aligned, which causes the items to lean against and contact an adjacent item, which in turn can restrict air flow and inhibit proper temperature control of the items. When the items are perishable or store perishables therein, such as food products, lack of sufficient air circulation can lead to spoilage or cause improper processing of the food product once it is thawed. Insufficient air flow can also increase blast-freezing and tempering cycles, resulting in increased inventory losses and utility costs.

SUMMARY

Accordingly, one embodiment of the present invention is a pallet spacer configured to ensure proper spacing between adjacent items which can lead to improved air flow around the palletized items. More particularly in one embodiment the invention is a pallet spacer system including a pallet spacer having a pallet spacer body with a plurality of upper portions. Each upper portion has a generally flat upper surface that is aligned with the upper surfaces of the other upper portions. The pallet spacer body further includes a plurality of lower portions, each lower portion having a generally flat lower surface that is aligned with the lower surfaces of the other lower portions. The pallet spacer system includes a plurality of spacers positioned on the upper portions and configured to receive at least an item therebetween.

DETAILED DESCRIPTION

Figure 1:
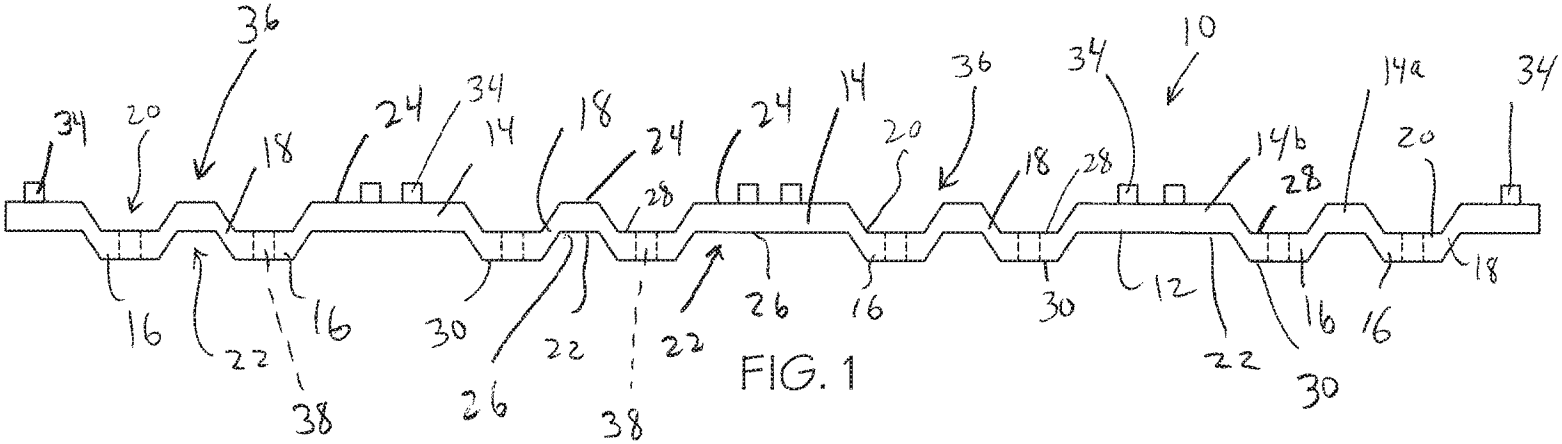
FIG. 1 is an end view of one embodiment of a pallet spacer.
Figure 2:
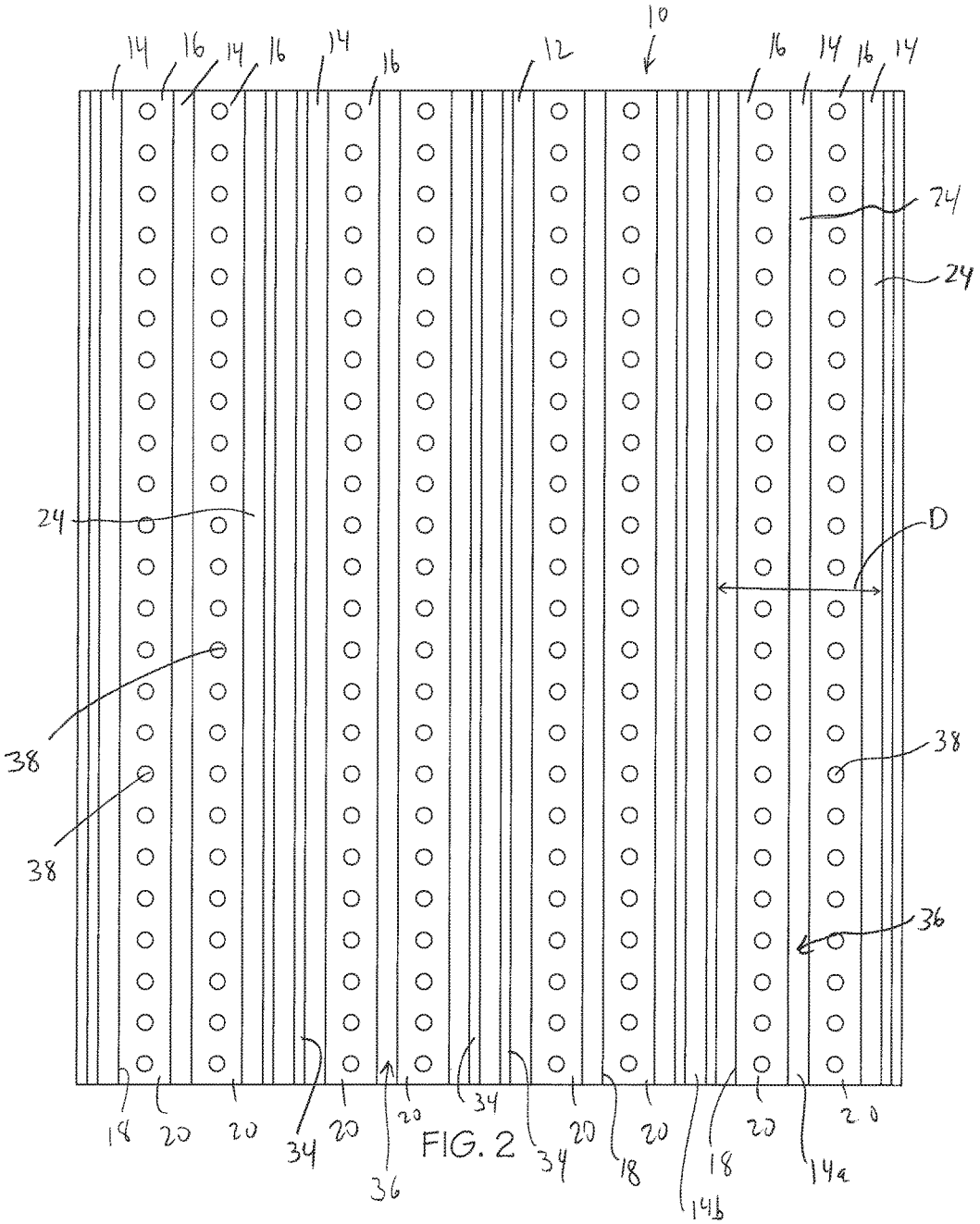
FIG. 2 is a top view of the pallet spacer of FIG. 1.

With reference to FIGS. 1-4, in one embodiment the pallet spacer 10 includes a pallet spacer body 12 having a plurality of upper portions 14, a plurality of lower portions 16, and a plurality of transition portions 18 coupled to and extending between the upper portion 14 and lower portions 16. The upper portions 14 are laterally spaced apart from each other to define a plurality of upper channels 20 therebetween, and the lower portions 16 are laterally spaced apart from each other to define a plurality of lower channels 22 therebetween.

Figure 3:
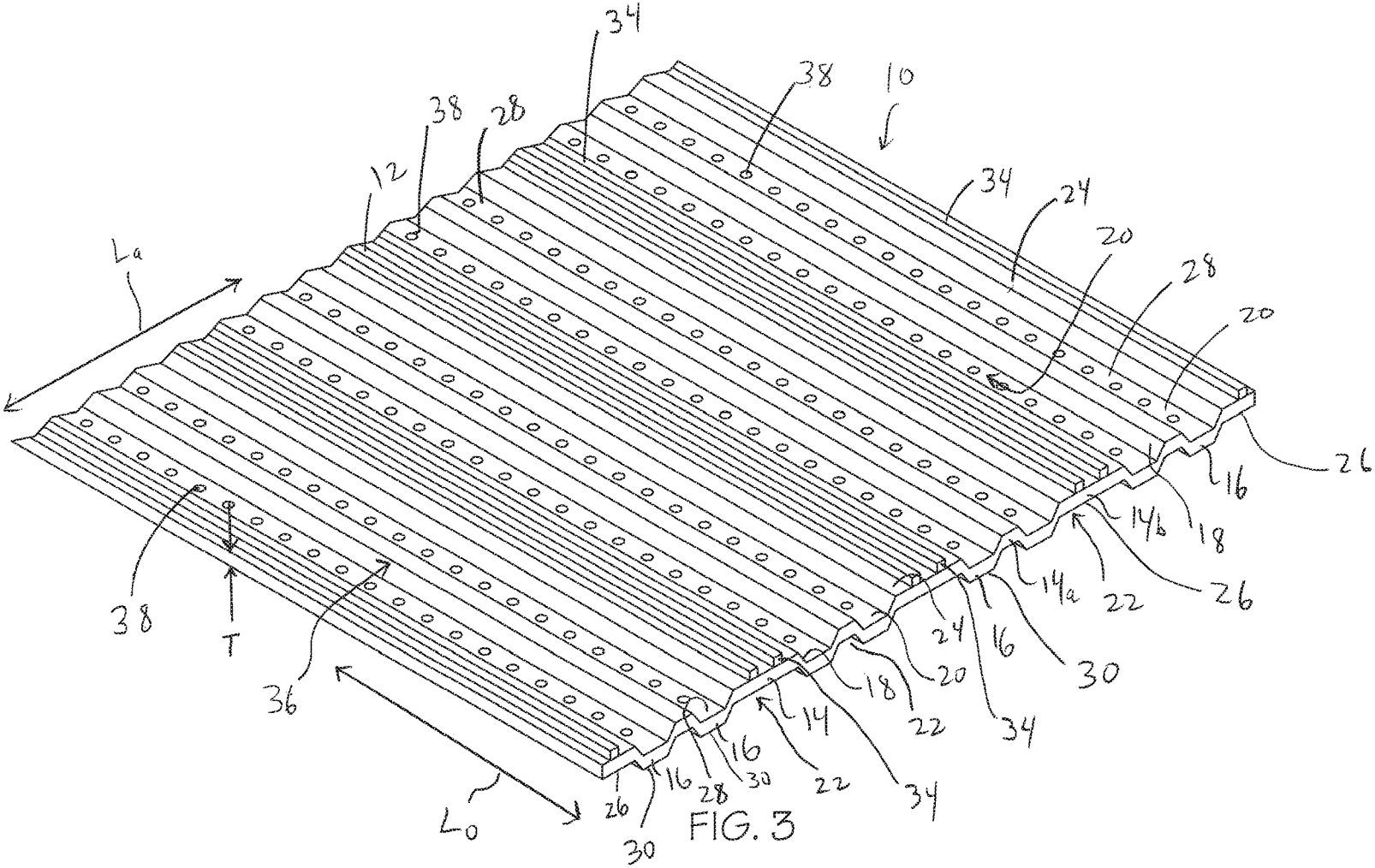
FIG. 3 is a front perspective view of the pallet spacer of FIG. 1.

With reference to FIG. 3, the pallet spacer 10 can have a longitudinal dimension extending in the direction $L_o$ and each upper portion 14, lower portion 16 and channel 20, 22 can extend generally parallel to the longitudinal direction. The pallet spacer 10 can also have a lateral dimension extending in the direction $L_a$ extending generally perpendicular to the longitudinal direction $L_o$ wherein the longitudinal and lateral dimensions are aligned in a plane of the pallet spacer 10. The pallet spacer 10 can also have a thickness direction or dimension T oriented perpendicular to the longitudinal direction $L_o$ and the lateral direction $L_a$. Thus the terms "upper" and "lower" as used herein are generally with reference to the thickness direction T of the spacer body 12.

In one case the spacer body 12, including the upper portions 14, lower portions 16 and transition portions 18, can each have generally the same thickness. However, the thickness dimensions of the upper portions 14, lower portions 16 and/or transition portions 18 can be varied as desired.

Figure 4:
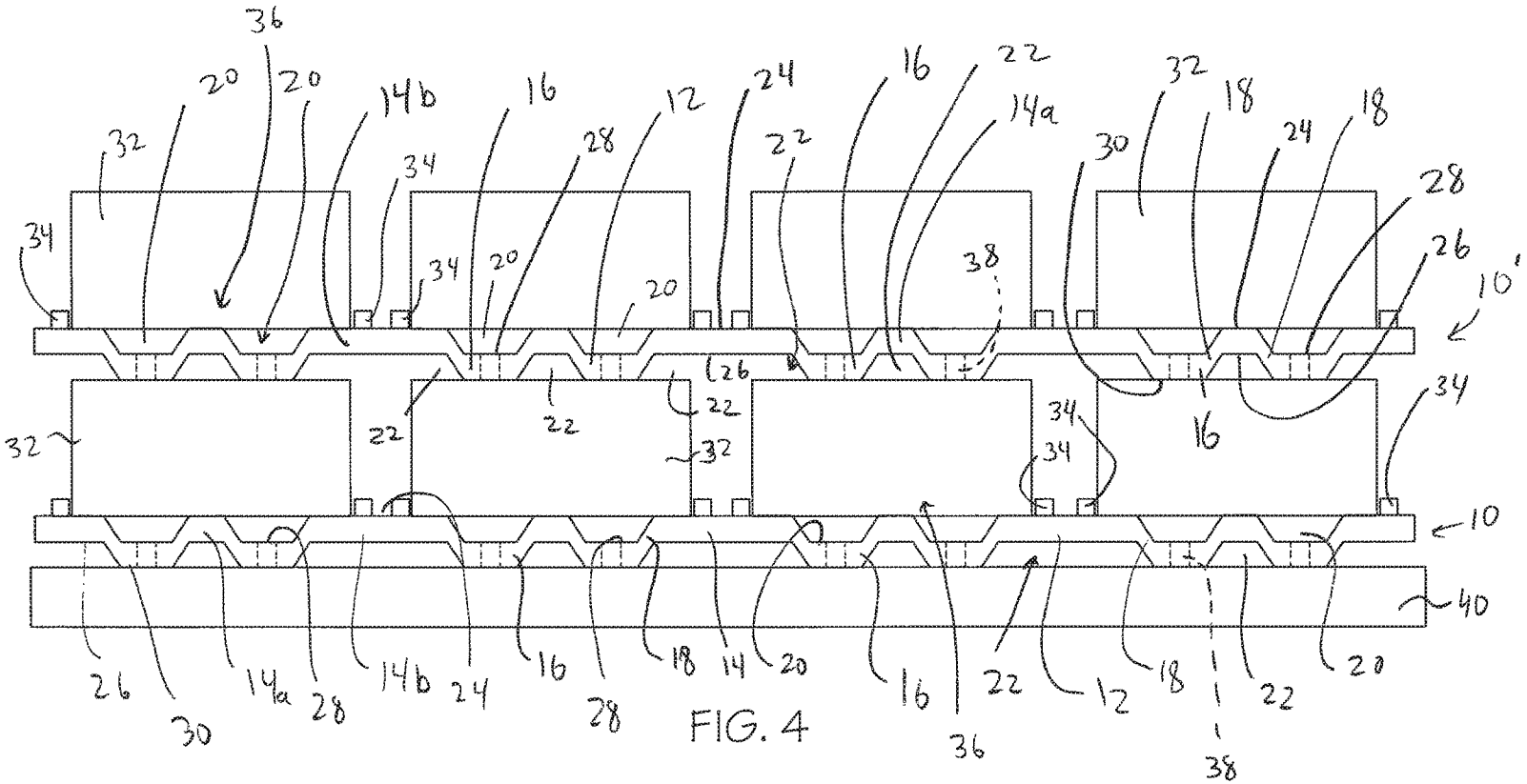
FIG. 4 is an end view of multiple pallet spacers positioned on a pallet and storing cases thereon.

In the illustrated embodiment, each upper portion 14 includes a generally flat and planar upper surface 24 and a generally, parallel flat and planar lower surface 26, and each lower portion 16 includes a generally flat and planar upper surface 28 and a generally parallel, flat and planar lower surface 30. In this manner the upper surfaces 24 of the upper portions 14 together form a discontinuous outermost (upper) surface of the spacer body 12 on one side thereof, and the lower surfaces 30 of the lower portions 16 form another (lower) discontinuous outermost surface of the spacer body 12 on an opposite side thereof. The upper surfaces 24 of the upper portions 14 are generally aligned (e.g. in a plane) so that items or cases 32 can be stacked and supported thereon, as shown in FIG. 4. Similarly, the lower surfaces 30 of the lower portions 16 are generally aligned in a plane such that the pallet spacer 10 can be positioned on a flat surface, such as the aligned top surface of a plurality of cases or items 32 positioned below the pallet spacer 10, or on a pallet 40 as shown in FIG. 4.

The lower portions 16 can be recessed relative to the upper portions 14 such that, for example, the lower surfaces 30 of the lower portions 16 are positioned below, and not aligned with, the lower surfaces 26 of the upper portions 14. Similarly, the upper surfaces 24 of the upper portions 14 are positioned above, and not aligned with, the upper surfaces 28 of the lower portions 16. In the illustrated case, however, the lower surfaces 26 of the upper portions 14 are aligned (along a plane) with the upper surfaces 28 of the lower portions 16.

Each transition portion 18 can have parallel outer surfaces that are angled relative to the upper surface 24 of the upper portions 14, and/or the lower surfaces 30 of the lower portions 16. In the illustrated embodiment each transition portion 18 extends at an angle of about 45 degrees although the transition portions 18 can have other shapes and extend at other angles.

Since the upper surfaces 28 of the lower portions 16 form the base/bottom surface of the upper channels 20, this arrangement leads to upper channels 20 that have a depth about equal to a thickness of the upper portions 14. Providing upper channels 20 with this depth helps to provide sufficient clearance and air circulation around items 32 positioned on the pallet spacer 10. Similarly, in the illustrated embodiment the lower surfaces 26 of the upper portions 14 define an upper surface of the lower channels 22 such that the lower channels 22 have a depth about equal to a thickness of the lower portions 16 in the illustrated embodiment. However, the upper 20 and/or lower channels 22 can have various other thicknesses including in one case a thickness equal to at least about one half the thickness of the upper 14 and/or lower portion 16.

The pallet spacer 10 can include a plurality of spacers, spacer components or spacer rails 34 that extend along the longitudinal direction $L_o$ of the spacer body 12. Each spacer 34 can extend outwardly/upwardly from the upper surface 24 of each upper portion 14, and define a spacer distance D (FIG. 2) between adjacent spacers 34. The spacer distance D is configured to generally correspond to the lateral dimension of an item, case or the like 32 to be positioned on the pallet spacer 10. In this manner, as shown in FIG. 4, items 32 can be closely received between the spacers 34, which retain alignment and proper spacing between the items 32.

In one case each item 32 has a lateral dimension that is at least about 90 percent of the spacer distance D. Accordingly, the pallet spacer 10 can define a plurality of gaps 36 having a lateral dimension D positioned between adjacent spacers 34. Each of the gaps 36 can have equal spacing in the illustrated embodiment, and each gap 36 spans at least one channel 20 in the illustrated case. Four gaps 36 are provided in the illustrated embodiment although the pallet spacer 10 can provide at least one gap 36 in one case, or at least two gaps 36 in another case or at least three gaps 36 in another case, or more as desired.

In the illustrated embodiment, each spacer 34 takes the form a raised rail having a rectangular cross section and extending generally the entire longitudinal dimension of the pallet spacer body 12. However, if desired each spacer 34 can take a variety of shapes and forms and can, for example, have other cross sectional shapes and/or take the form of a discontinuous series of spacer components 34, such as knobs, cylinders or the like spaced along the length of the pallet spacer body 12.

The pallet spacer body 12 can also include a plurality of openings or holes 38 formed through a thickness thereof to aid in air circulation. In the illustrated embodiment the openings 38 are located at the bottom of the upper channels 20 and extend through the lower portions 16 in a direction generally perpendicular to the upper surfaces 28 of the lower portions 16. However, if desired, the holes 38 can be located at different positions and have different shapes.

The pallet spacer 10 can have a variety of shapes and configurations to correspond to the shape of the items 32 to be stored thereon. In the particular illustrated embodiment, the spacer body 10 includes alternating relatively laterally-short upper portions 14*a* and relatively laterally-long upper portions 14*b*. This configuration can provide a relatively laterally-short upper portion 14*a* positioned between two relatively laterally-long upper portions 14*b*. As shown in FIG. 4, in this configuration the outer ends of an item 32 can be supported on two different relatively laterally-long upper portions 14*b*, while the center or middle portion of the item 32 is supported on a single relatively laterally-short upper portion 14*a*. This configuration provides two upper channels 20 under each item 32, and three (or parts of three) lower channels 22 above each item 32 to provide sufficient air circulation. However, the upper portions 14*a*, 14*b* can be sized and configured as desired, and the items 32 supported by or positioned thereon can be arranged in various configurations.

In the illustrated embodiment the spacers 34 are positioned only on the relatively laterally-long upper portions 14*b*, and no spacers 34 are positioned on the relatively laterally-short upper portions 14*a*. Moreover, in the illustrated embodiment, none of the lower portions 16 include any spacers positioned 34 thereon. In the illustrated embodiment each lower portion 16 has generally the same lateral dimension. However, the spacer positioning, configuration and spacing of the upper 14 and lower portions 16 can be varied as desired to accommodate differently sized and shaped items 32 to be stored on the pallet spacer 10.

In order to utilize the pallet spacer 10, with reference to FIG. 4, a pallet 40 or other support can be provided, and a pallet spacer 10 positioned on the pallet 40. Next, a plurality of items 32 can be stacked in a row (or rows and columns) on the pallet spacer 10, with the items 32 resting on the upper portions 14 and closely received between adjacent spacers 34. Next, another pallet spacer 10' can be provided and positioned on top of the stacked items 32, with the generally flat lower surfaces 30 of the lower portions 16 resting on the generally flat upper surfaces of the items 32. Another row of items 32 can be positioned on the pallet spacer 10' and supported by the pallet spacers 10, 10' and items 32 positioned therebelow. Additional rows of pallet spacers 10 and items 32 (not shown) can be stacked as desired.

The pallet spacer system as described herein provides increased air flow around palletized cases or items 32 such that, when the palletized system is positioned in a temperature controlled environment, efficient heat transfer is enabled. The spacer rails 34 of the pallet spacers 10 also position and retain the items 32 to establish consistent, controlled spacing between adjacent items 32. In addition, the pallet spacer 10 provides channels 20, 22 above and below the items 32, and provide a relatively small surface area supporting the stored items 32, to thereby increase the size of the channels 20, 22. The generally flat surfaces 24, 30 of the upper 14 and lower 16 panels enable items 32 to be flatly stacked thereon and thereunder, and provide sufficient surface area to transfer weight forces so that items 32 can be stacked without being crushed. The openings 38 further increase air circulation to help yield consistent temperatures in the items 32, and also reduce the weight of the pallet spacer 10. Finally, when not in use the pallet spacers 10 can be stacked in a nested arrangement to provide space saving.

Although the pallet spacers 10 can be made from a variety of materials and in a variety of manners, in one embodiment the pallet spacers 10 are manufactured of manifold-injected polypropylene, but also can be extruded due to a uniform thickness or cross-sectional shape (except for the openings 38 which can be formed after extrusion). Thus, in one embodiment, the pallet spacer 10 has a constant or generally constant cross-sectional shape, excluding the openings 18, along its entire length. In another embodiment, the pallet spacer 10 has a cross-sectional shape that is constant (excluding the openings 18) or generally constant for at least about one foot of length or at least about two feet of length in the longitudinal direction, to accommodate commonly-sized items 32. Further alternately, each upper portion 14 and/or lower portion 16 and/or transition portion 18 can have a constant thickness or shape excluding the openings 18 along the entire length of the pallet spacer 10, or for at least about one foot or at least about two feet in the longitudinal direction.

Having described the invention in detail and by reference to the various embodiments, it should be understood that modifications and variations thereof are possible without departing from the scope of the claims of the present application.

What is claimed is:

1. A pallet spacer system comprising a pallet spacer having:

a pallet spacer body including a plurality of upper portions, each upper portion having a generally flat upper surface that is aligned with the upper surfaces of the other upper portions, the spacer body further including a plurality of lower portions, each lower portion having a generally flat lower surface that is aligned with the lower surfaces of the other lower portions, wherein each upper portion has a lower surface and each lower portion has an upper surface, wherein the lower surfaces of said upper portions are generally aligned with the upper surfaces of the lower portions, wherein said spacer body has a plurality of openings extending entirely through a thickness thereof, and wherein the lower portions lack any spacers positioned thereon; and a plurality of spacers positioned on said upper portions and configured to receive at least an item therebetween.

2. The system of claim 1 wherein the upper surfaces of said upper portions are not aligned with the upper surfaces of the lower portions, and wherein the lower surfaces of said upper portions are not aligned with the lower surfaces of the lower portions.

3. The system of claim 1 wherein said upper surfaces of said upper portions together form a discontinuous outermost surface of said spacer body on one side thereof and wherein said lower surfaces of said lower portions together form another discontinuous outermost surface of said spacer body on an opposite side thereof.

4. The system of claim 1 wherein the upper portions are spaced apart from each other defining upper channels therebetween, and wherein each upper channel has a depth equal to at least about half a thickness of said upper portions.

5. The system of claim 1 wherein the upper portions are spaced apart from each other defining upper channels therebetween, wherein said upper channels extend in a longitudinal direction, and wherein adjacent ones of said spacers define a gap therebetween in a lateral direction perpendicular to said longitudinal direction, and the system has at least three gaps having the same lateral dimension.

6. The system of claim 1 wherein the lower portions are spaced apart from each other defining lower channels therebetween, and wherein each lower channel has a depth equal to at least about half a thickness of said lower portions.

7. The system of claim 1 wherein the spacer body has a generally constant thickness.

8. The system of claim 1 wherein said spacer body has a generally constant cross sectional shape along its entire longitudinal dimension.

9. The system of claim 1 wherein the spacer body includes a plurality of transition portions extending between an upper portion and a lower portion, and wherein each transition portion has outer surfaces that are angled relative to said upper surfaces of said upper portions.

10. The system of claim 9 wherein said upper portions, said lower portions, and said transition portions all have about the same thickness.

11. The system of claim 1 wherein each spacer is oriented perpendicular to said upper surfaces of said upper portions.

12. The system of claim 1 wherein each spacer extends generally an entire longitudinal dimension of said pallet spacer body.

13. The system of claim 1 wherein all lower portions of said spacer body have generally the same lateral dimension.

14. The system of claim 1 wherein said openings are positioned in said plurality of lower portions.

15. The system of claim 1 further comprising a plurality of items positioned on said upper surfaces of said upper portions, each item being closely received between a pair of adjacent spacers, the system further comprising a supplemental pallet spacer positioned such that said lower portions of said supplemental pallet spacer are supported by said items.

16. A pallet spacer system comprising a pallet spacer having:

a pallet spacer body including a plurality of upper portions, each upper portion having a generally flat upper surface that is aligned with the upper surfaces of the other upper portions, the spacer body further including a plurality of lower portions, each lower portion having a generally flat lower surface that is aligned with the lower surfaces of the other lower portions, wherein said spacer body includes a relatively laterally-short upper portion positioned between two relatively laterally-long upper portions; and a plurality of spacers positioned on said upper portions and configured to receive at least an item therebetween.

17. The pallet spacer of claim 16 wherein each relatively laterally-long upper portion includes a spacer positioned thereon, and wherein said relatively laterally-short upper portion lacks a spacer positioned thereon.

18. A pallet spacer system comprising a pallet spacer having:

a pallet spacer body having a generally flat, discontinuous upper surface with a plurality of longitudinally-extending channels formed therein and a generally flat, discontinuous lower surface with a plurality of longitudinally-extending channels formed therein, wherein each channel of said upper surface has a depth equal to at least about half a thickness of said spacer body, and wherein the spacer body includes a plurality of transition portions extending between the upper surface and the lower surface, each transition portion having outer surfaces that are angled relative to said upper surface; and a plurality of spacers positioned on said upper surface and configured to receive at least one item therebetween, wherein said lower surface lacks any spacers positioned thereon.

19. The system of claim 18 wherein each upper channel has a depth about equal to a thickness of the spacer body, and wherein said spacer body includes a relatively laterally-short upper surface portion positioned between two relatively laterally-long upper surface portions.

20. The system of claim 18 wherein all lower surface portions of said spacer body have generally the same lateral dimension.

* * * * *